US007249870B1

(12) United States Patent
Shwisha

(10) Patent No.: US 7,249,870 B1
(45) Date of Patent: Jul. 31, 2007

(54) LIGHT FIXTURE HAVING A HOUSING WITH A CHANNEL FOR RECEIVING A FRONT ELEMENT

(75) Inventor: Gordon L. Shwisha, Westport, CT (US)

(73) Assignee: Electrix, Inc., New Haven, CT (US)

( * ) Notice: Subject to any disclaimer, the term of this patent is extended or adjusted under 35 U.S.C. 154(b) by 199 days.

(21) Appl. No.: 10/752,143

(22) Filed: Jan. 6, 2004

(51) Int. Cl.
*F21S 8/00* (2006.01)

(52) U.S. Cl. ..... 362/368; 362/147; 362/151; 362/223; 40/558

(58) Field of Classification Search ..... 362/223, 362/147, 151, 367, 368; 40/553, 558, 575, 40/576, 124.02
See application file for complete search history.

(56) References Cited

U.S. PATENT DOCUMENTS 1,249,500 A * 12/1917 Richter ..... 362/147
2,544,359 A * 3/1951 Schmidt ..... 362/362
2,810,823 A * 10/1957 Guth, Jr. ..... 362/224
2,893,148 A * 7/1959 Murray ..... 40/576
2,922,029 A * 1/1960 Eschelbach et al. ..... 362/151
2,941,323 A * 6/1960 McKiernan ..... 40/576
3,516,187 A * 6/1970 Espinosa ..... 40/575
4,229,779 A * 10/1980 Bilson et al. ..... 362/260
4,383,382 A * 5/1983 Hegarty ..... 40/575
4,531,180 A * 7/1985 Hernandez ..... 362/362
4,725,931 A * 2/1988 Bourdon ..... 362/147
4,881,156 A 11/1989 Shemitz et al.
5,001,613 A * 3/1991 Foster et al. ..... 362/223
5,020,252 A * 6/1991 De Boef ..... 362/260
5,226,724 A * 7/1993 Kanarek ..... 362/260
5,550,725 A 8/1996 Shemitz et al.
6,705,742 B1 * 3/2004 Patterson et al. ..... 362/224

* cited by examiner

*Primary Examiner*—Jong-Suk (James) Lee
*Assistant Examiner*—Ismael Negron
(74) *Attorney, Agent, or Firm*—Bachman & LaPointe, P.C.

(57) ABSTRACT

A light apparatus has an elongate bulb extending essentially in a first direction. An elongate reflector has a first surface generally facing the bulb and a second surface generally facing away from the bulb. A housing supports the reflector and bulb. The housing has a back portion for mounting the apparatus to a wall. The housing has a lower portion extending forward from the back portion and extending below the reflector and bulb and having an upwardly open channel. The housing has a front element having a lower edge portion accommodated within the channel and extending upward forward of the bulb.

14 Claims, 4 Drawing Sheets

LIGHT FIXTURE HAVING A HOUSING WITH A CHANNEL FOR RECEIVING A FRONT ELEMENT

BACKGROUND OF THE INVENTION (1) Field of the Invention

The invention relates to electric lighting. More particularly, the invention relates to light fixtures for indirect lighting.

(2) Description of the Related Art

A well-developed field exists in lighting fixtures. One particular area involves elongate fixtures used for indirect lighting. Such fixtures typically include an elongate bulb within an elongate reflector positioned so that light from the bulb and reflector does not directly pass to objects within a room but, rather, is first diffusely reflected from a ceiling, wall, or other architectural feature. For such fixtures, end-to-end assembly of multiple fixtures is known as is orientable reflectors. One class of elongate reflectors are known as "asymmetric" reflectors whose cross-sections are characterized as a segment of a mixed parabola and ellipse.

Exemplary systems are shown in U.S. Pat. Nos. 4,881,156 and 5,550,725. Nevertheless, there remains room for improvement in the field.

SUMMARY OF THE INVENTION

Accordingly, one aspect of the invention involves a light apparatus. An elongate bulb extends essentially in a first direction. An elongate reflector has a first surface generally facing the bulb and a second surface generally facing away from the bulb. A housing has a first surface contacting the reflector second surface. The reflector is securably mounted to the housing to permit the reflector to be reoriented by slidably moving the reflector second surface along the housing first surface.

In various implementations, the housing first surface may include first and second concave surfaces spaced-apart in the first direction. The housing first surface may comprise a concave surface aligned with a threaded aperture. The reflector may have a slot relative to the first direction and transversely elongate aligned with the aperture. A screw may extend through the slot and into the aperture to permit the reflector to be fastened in any of a number of orientations. There may be a combination of multiple such light apparatus positioned end-to-end. The first end of one receptacle of one apparatus may be within a short distance (e.g., 5 cm) of a second end one receptacle of the next apparatus.

Another aspect of the invention involves a light apparatus having a housing supporting a reflector and bulb. A housing back portion mounts the apparatus to a wall. A housing lower portion extends forward from the back portion and below the reflector and bulb and has an upwardly open channel. A front member has a lower edge portion accommodated within the channel and extending upward forward of the bulb.

In various implementations, the channel may extend a majority of a length of the housing. The front member may be a translucent diffuser or an opaque panel (e.g., metal). There may be a combination of such apparatus wherein a bracket spans a junction between the lower portions of adjacent pairs of the apparatus. The bracket may be secured to the lower portions and have a forward portion contacting aft surfaces of the front members of the adjacent apparatus so as to bias the front members into alignment with each other.

Another aspect of the invention involves a method for assembling a light apparatus to a wall of a building. A mounting plate extrusion is secured to the wall. A first portion of a lower extrusion is engaged with a first portion of the mounting plate extrusion. The lower extrusion is rotated downward to a self-supporting orientation extending generally forward from the mounting plate extrusion. A bulb socket and reflector are assembled to at least one of the lower extrusion and the mounting plate extrusion.

In various implementations, the engaging may involve inserting a finger of the lower extrusion into a channel in the mounting plate extrusion or vice versa. The rotating may include rotating the lower extrusion downward about the channel to the self-supporting orientation. The assembly may include assembling a ballast, the bulb socket, and the reflector to the mounting plate extrusion. An elongate front member may be mounted to the lower extrusion. The front member may extend generally upward from a channel in the lower extrusion proximate a forward edge thereof. The method may be repeated with multiple such apparatus wherein the lower extrusion of each apparatus is secured to the lower extrusion of an adjacent apparatus with a bracket spanning a junction therebetween. The bracket may bias or otherwise retain the front members of the two apparatus in alignment with each other.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
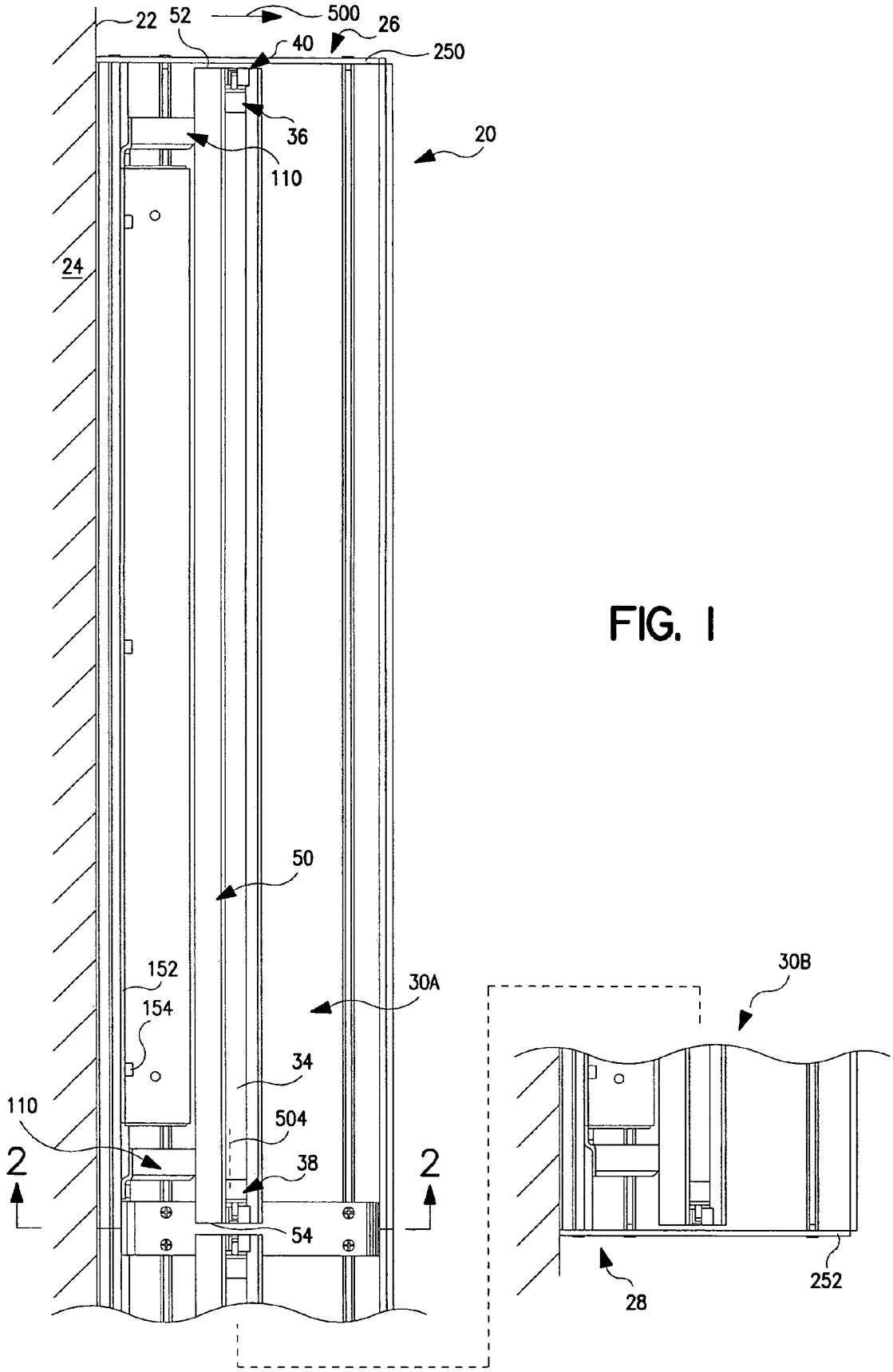
FIG. 1 is a top view of a light fixture assembly according to principles of the invention.

FIG. 1 shows a light fixture assembly 20 mounted to a surface 22 of a wall 24. For convenient reference, a forward direction 500 is defined as away from the wall and an upward direction is out of the page. With left and right defined from the point of view of a person standing upright and facing in the forward direction, the fixture assembly extends from a left end 26 to a right end 28. The assembly may include one, two, or more individual fixture units assembled end-to-end. This direction of assembly is identified as longitudinal. FIG. 1 shows two exemplary units 30A and 30B. In the illustrated embodiment, each unit includes a bulb 34 (e.g., an elongate fluorescent bulb extending along a bulb axis 504 between a left end 36 and a right end 38). The exemplary bulb is held by a socket or receptacle 40 having separate left and right end portions for engaging contacts in associated bulb end portions in a known or other manner. The bulb and socket are located within a reflector 50 which, like the bulb, extends between left and right ends 52 and 54. Exemplary unit lengths are 30 cm-2 m.

Figure 2:
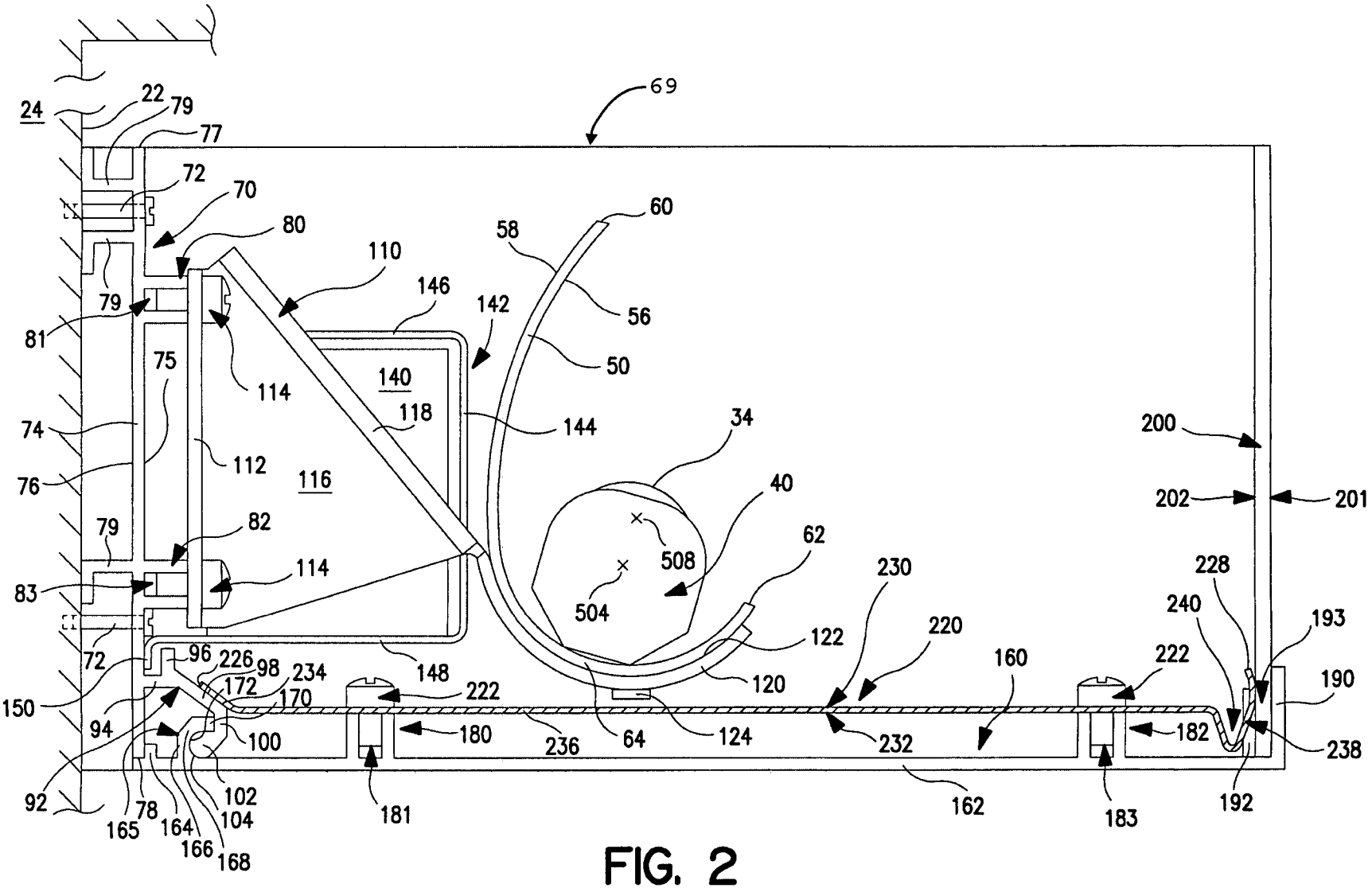
FIG. 2 is a cross-sectional view of the fixture assembly of FIG. 1, taken along line 2-2.

FIG. 2 shows further details of the reflector 50. The reflector has general symmetry along the longitudinal direction, having first and second principal surfaces 56 and 58 extending between the ends 52 and 54 and first and second rim surfaces 60 and 62. The exemplary shape of the reflector 50 is approximately a segment of an ellipse/parabola hybrid including one end 64 of such hybrid. For convenient reference, the hybrid may be approximated as an ellipse. With reference to that ellipse, the first surface 56 is generally interior and generally faces the bulb (e.g., there is a line of sight from points on such surface to the bulb not obscured by the arc of the reflector). The second surface 58 is exterior to the ellipse and generally faces away from the bulb (e.g., there is no line of sight from points on the surface 58 to the bulb without passing through the reflector and the first surface 56). In the exemplary embodiment, the bulb axis 504 is positioned near (e.g., slightly outboard of) the focus 508 of the ellipse adjacent the end 64.

FIG. 2 further shows additional structural details of a housing holding the reflector, socket, and bulb. The illustrated housing has an open top defined by a top opening 69. FIG. 2 shows the reflector positioned to direct light upward to be passed through the top opening. The housing includes a back plate 70 mounted to the wall 24 by mounting means such as screws 72. The exemplary back plate is formed as an extrusion substantially having symmetry along the longitudinal direction. Exemplary back plate material is an aluminum alloy. In cross-section, the extrusion includes a principal vertical web 74 having front and back surfaces 75 and 76, and upper and lower edges 77 and 78. Several L-sectioned support legs 79 extend back from the web 74 with their foot portions bearing against the wall surface 22 to offset the web in front of the wall and parallel thereto. Upper and lower pairs 80 and 82 of parallel spaced-apart flanges extend forward from the web 74 to define therewith respective upper and lower forwardly-open channels 81 and 83. As is described below, the channels 81 and 83 may serve for mounting additional components to the back plate 70.

Slightly upwardly offset from the web lower edge 78, a finger 92 has a short forwardly-extending trunk portion 94. From the forward end of the trunk portion, there is a short upwardly-extending branch 96 and a longer forward and downward-extending first portion 98 of a second branch. From the distal end of the first portion 98, a short second portion 100 depends. From the distal end of the second portion 100, a bulbously protuberant end portion 102 extends backward toward. The exemplary end portion has a curved end surface 104.

The housing further includes an exemplary pair of reflector support brackets 110. Exemplary brackets 110 are formed of an aluminum alloy. FIG. 1 shows left and right brackets 110 longitudinally spaced-apart and slightly recessed relative to the respective reflector left and right ends 52 and 54. The recessing is advantageously sufficient so that the brackets 110 do not interfere with the adjacent end portions of the receptacle 40. The receptacle end portions are secured to the reflector such as by screws (not shown). The recessing of the brackets from the ends of the reflector also may keep the brackets away from hardware securing the units end-to-end, thereby allowing the end portions of adjacent receptacles of adjacent units to be in very close proximity (e.g., within 5 cm, more narrowly 1 cm or 0.5 cm). This close proximity provides close proximity of the bulbs of the adjacent units and, thereby, minimizes gaps in lighting. An exemplary proximity is about 0.3 cm (FIG. 1 exaggerates the separation for illustration).

Figure 3:
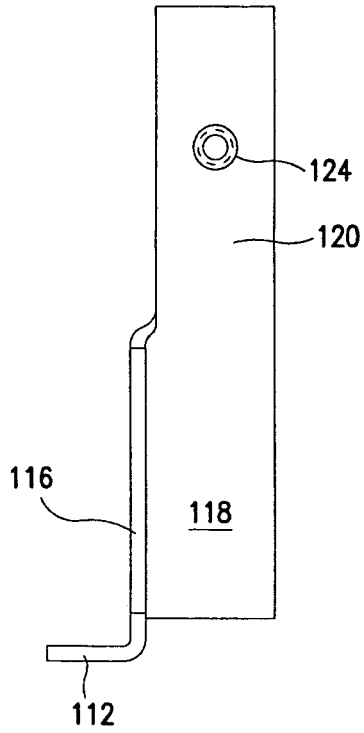
FIG. 3 is a bottom view of a reflector mounting bracket of the fixture assembly of FIG. 1.

Each exemplary bracket 110 has a vertical mounting flange 112 lying flat against the rims of flange pairs 80 and 82 of the channels 81 and 83 and secured thereto with fasteners 114 (e.g., a pair of self-tapping screws extending through holes in the bracket flange 112 and having a thread outer diameter slightly greater than a channel interior width). Extending forward from one of the left or right edges of the bracket flange 112, the bracket has a structural web 116. The exemplary web 116 is triangular in form having one long edge along the flange 112 and a second long edge along a flange 118 extending forward and downward from a near junction with the flange 112. The flange 118 ends in an arcuate reflector-receiving portion 120 having a generally upward facing concave surface 122 for receiving a portion of the reflector second surface 58. The portion 120 has a depending threaded boss 124 (FIG. 3) which receives a fastener 126 (e.g., a screw) (FIG. 4) extending through an elongate (e.g., obround) slot 128 in the reflector having fore and aft ends 130 and 132.

Figure 4:
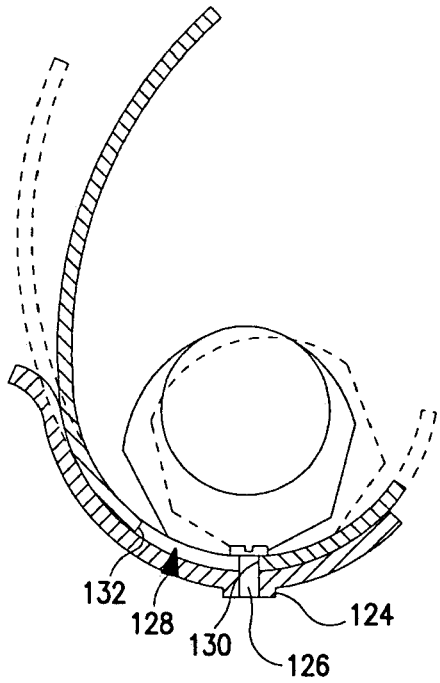
FIG. 4 is a partially schematic cross-sectional view of a bracket and reflector.

FIG. 4 further shows how the reflector may be rotated relative to the housing. The solid line showing of FIG. 4 has the slot forward end 130 abutting the shaft of the screw 126 at one extreme of a range of motion. The reflector may be shifted (e.g., with the socket and potentially the bulb as a unit) to bring the screws 126 toward or all the way to the slot second ends 132. The screws 126 may be tightened to lock the reflector in a given orientation. There may be an elastic deformation of the reflector to accommodate interaction with the curvature of the support. Exemplary reflector material is steel or aluminum alloy.

Returning to FIG. 2, a ballast unit 140 may be mounted to the housing. An exemplary ballast unit is mounted by means of a cover/mounting system 142. The exemplary cover 142 has a front wall 144 and top (upper) and bottom (lower) walls 146 and 148 extending rearward from upper and bottom edges of the front wall. At a rear edge of the lower wall 148, a finger 150 depends and is captured between the branch 96 and web 74. At a rear edge of the top wall 146, a short rear wall 152 (FIG. 1) extends upward and has apertures through which screws 154 extend into the back plate upper channel 81.

The exemplary housing further includes a lower member or bottom plate 160 (FIG. 2) which may be formed as an extrusion similarly to the back plate. In front-to-back vertical section, the bottom plate has a web 162 extending from a back edge to a front edge and having upper and lower surfaces. Slightly ahead of the back edge, a short finger 164 extends upward from the upper surface and has an aft surface abutting the front surface of the back plate principal vertical web 74 near the lower edge thereof. Aft of the finger 164, the back plate web lower edge 78 contacts the upper surface of the web 162. Forward of the finger 164, a second finger 165 has a proximal portion 166 extending upward, an intermediate portion 168 extending forward and upward therefrom, and a distal portion 170 extending forward from the intermediate portion. The finger combines with the upper surface to form a channel surface 172 engaging the exterior surface 104 of the end portion 102 of the back plate finger 92. A distal end of the finger 165 engages an aft surface of the second portion 100 of the finger 92.

Forward of the finger 165, a pair 180 of flanges extend upward from the web 162 to define a channel 181 similar to the channels 81 and 83. Similarly, a pair 182 of flanges extend upward from the web recessed from the forward edge thereof to define a channel 183. At the forward edge, a short flange 190 extends upward. Spaced slightly behind the flange 190, another flange 192 extends upward. In the exemplary embodiment, the flange 192 is laterally recessed a short distance from the left and right edges of the lower member as described in further detail below. The flanges 190 and 192 form a channel 193 which can accommodate a lower portion of a front member 200. An exemplary front member may be opaque, transparent, or translucent, or combinations thereof and has a front/fore surface 201 and a rear/aft surface 202. The color and texture of an opaque front member (e.g., a generally rectangular aluminum alloy sheet/plate) may serve to integrate it into the architectural background. The color and pattern of a translucent front member may also provide background integration and may provide desired lighting effects. An exemplary diffuser is a transparent acrylic having digitally applied patterning and coloration to provide a desired translucent effect. A hybrid may have transparent or translucent windows (in a regular or irregular pattern or design) in an opaque matrix or vice versa.

The bracket 220 spans the junction between each pair of lower members 160 and is secured to each such lower member such as by a pair of screws 222 extending through holes in the bracket into threaded engagement with the channels 181 and 183 defined by the flange pairs 180 and 182. Exemplary brackets 220 are formed as bent rectangular metal plates (e.g., of spring steel) extending from a rear end 226 to a front end 228 and having left and right edges and generally upper and lower surfaces 230 and 232. An aft portion 234 is bent upward relative to a principal body portion 236 and, along the lower surface 232 is in compressive engagement with the upper/forward surface of the portion 98 of the finger 92. This compressive engagement biases the lower member 162 downward into its forwardly-extending orientation of FIG. 2 (as is discussed further below). A forward portion 238 of the bracket has bends defining a channel 240 and has a forwardly-facing portion of the surface 232 in contact with the aft surface 202 of the front member 200. It is to permit this contact that the flange 192 is laterally recessed relative to remaining left or right edge portions of the lower member 160. The resilient spring engagement of the bracket 220 with the front member biases the front member into flat engagement with the flange 190 to maintain a vertical orientation of the front member. With each bracket 220 spanning front members of two units, the front members are maintained in coplanar relationship for aesthetic purposes (e.g., for smoothness if the front member is visible and/or to prevent misalignment gaps through which light can pass even if not visible).

Figure 5:
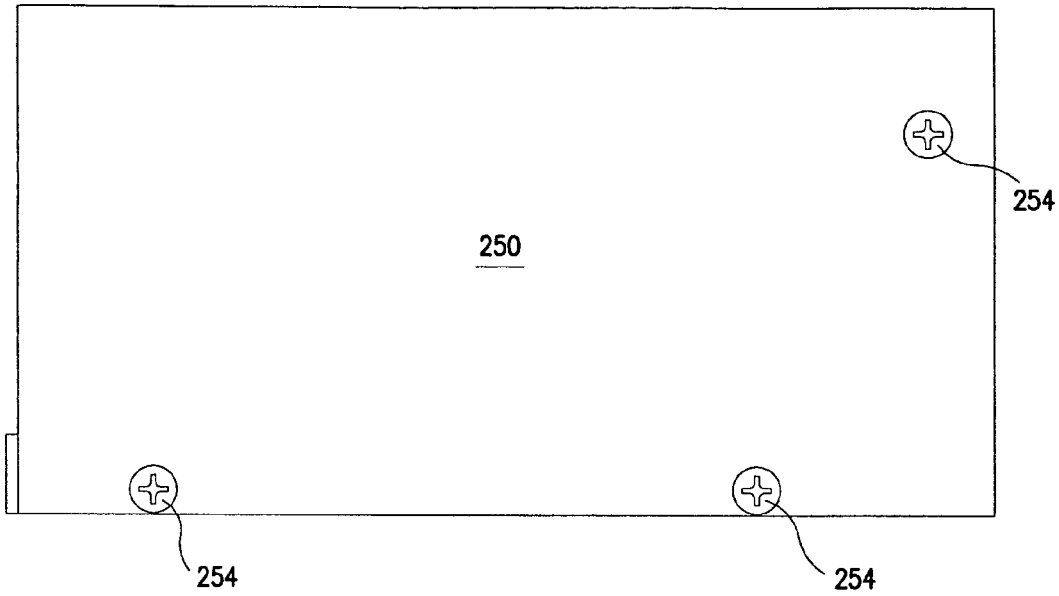
FIG. 5 is an end view of the assembly of FIG. 1.

Returning to FIG. 1, at left and right extremes of the unit assembly, the assembly may include left and right endwalls 250 and 252. These endwalls may have channels for capturing and positioning the left and right edges of the respective left- and right-most front members. FIG. 5 shows a left endwall 250 secured by countersunk screws 254 in the three channels 81, 181, and 183 defined by the flange pairs 80, 180, and 182 of the associated back plate and lower member. Exemplary endwall material is aluminum or zinc alloy.

Figure 6:
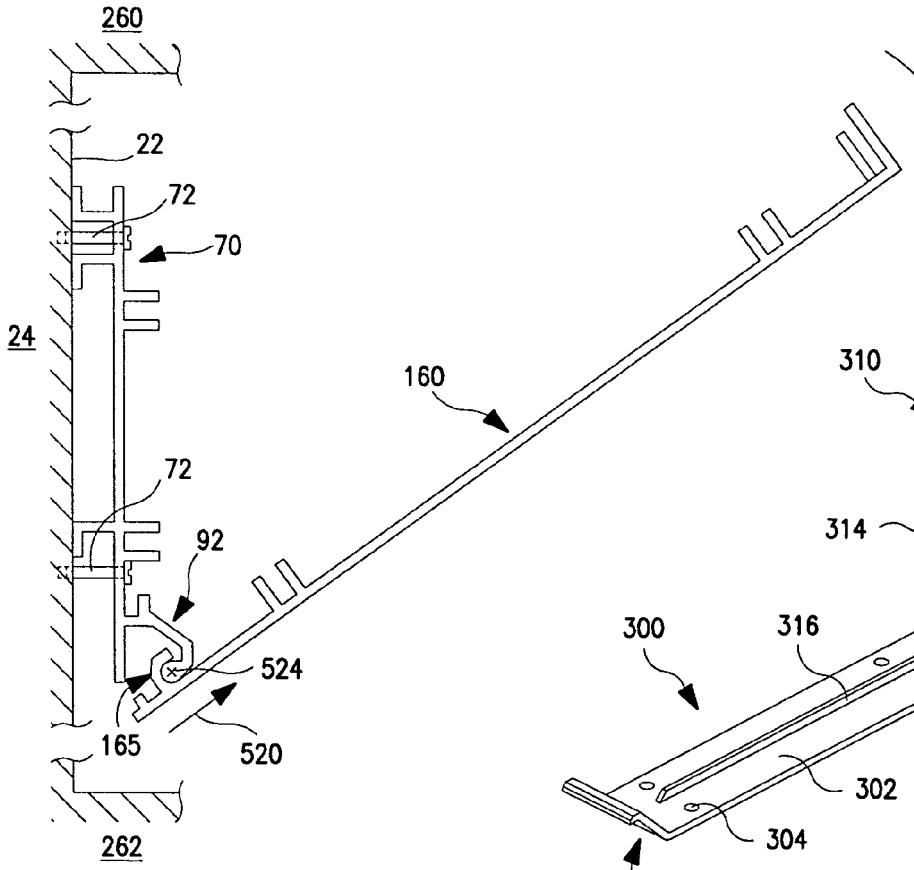
FIG. 6 is a side view of a back plate and lower member of the assembly of FIG. 1 in an initial stage of assembly.

In exemplary sequences of assembly, each unit may be assembled individually, the units may be assembled essentially simultaneously, or some combination thereof. In an exemplary first step, the back plate(s) 70 are positioned along the surface 22 of the wall 24 at a desired location and secured thereto via the screws 72. In various installation situations, the back plate may be installed somewhat below a ceiling 260 or above a ledge 262 (FIG. 6). The lower member(s) 160 may then be installed by being oriented in a front-up inclination and shifted in a forward and upward direction 520 so that the lower member channel surface 172 engages the back plate finger end surface 104. The lower member may then be rotated downward in a direction 522 with the interengaged fingers 92 and 165 serving as a hinge having a hinge axis 524. When the lower member reaches the orientation of FIG. 2, interaction of the back plate web lower edge 78 with the lower member upper surface will prevent further downward rotation and engagement of the aft surface of the lower member finger 164 with the back plate front surface will prevent rearward movement of the lower member (and thus disengagement of the interengaged fingers). The brackets 220 may then be installed with the screws 222 or this step may be deferred. Similarly, the endwalls 250 and 252 may be installed or such step deferred.

With the lower members in place, the ballasts 140 may be installed. In an exemplary installation, the ballasts are placed within the cover/mounting system and the finger 150 thereof downwardly inserted into the channel between the web 74 and finger branch 96. The screws 154 may then be installed. The brackets 110 may also be installed via the screws 114. The bulb sockets 40 may be preassembled to the reflectors 50 and then installed as a unit. To install the reflectors 50, the reflectors are positioned on the reflector-receiving portions 120 and the screws 126 inserted through the reflector into the threaded bosses 124. The screws may be left sufficiently loose to permit rotation of the reflector through its orientational range. Alternatively, the reflectors may be first installed and the sockets installed thereafter. Wiring (not shown) may be connected between the sockets and the ballasts. The foregoing may all be part of an exemplary offsite preassembly prior to securing the back plate to the wall. The ballasts may be connected to an external power source. The bulbs 34 may be installed or this step may be deferred. The front members 200 may be downwardly inserted into the channels 193 between the flanges 190 and 192 against a camming spring interaction of the bracket forward portions 238.

Figure 7:
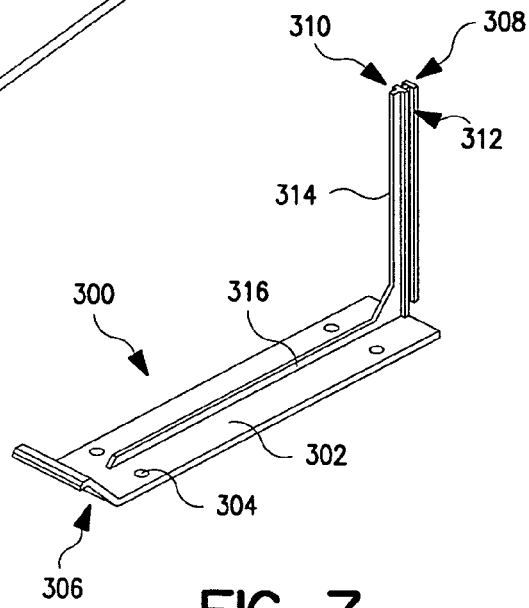
FIG. 7 is a view of an alternate fixture-connecting bracket.

FIG. 7 shows an alternate bracket 300 which may be used in place of the bracket 220. An exemplary bracket 300 is formed as a metallic casting (e.g., of an aluminum or zinc alloy). The bracket has a central plate portion 302 having holes 304 positioned similarly to the holes of the bracket 220 for accommodating the screws 222. A rear end portion 306 of the bracket extends upwardly at an angle from the plate portion 302 and serves to provide a similar biasing effect to that of the rear end portion of the bracket 220. At the forward end of the bracket, an upwardly-extending channel member 308 defines first and second opposed lateral channels 310 and 312 for receiving and retaining associated adjacent edge portions of the front members (e.g., diffusers) of the adjacent fixtures. In the exemplary embodiment, the channel member 308 has an I-shaped section augmented by an additional aft rib portion 314 continuous with a central rib 316 along the plate portion 302 for additional structural integrity.

One or more embodiments of the present invention have been described. Nevertheless, it will be understood that various modifications may be made without departing from the spirit and scope of the invention. For example, various elements may be combined or further separated. Additionally, a variety of structural shapes and cooperating features of the extrusion are possible. Various other manufacturing techniques and materials may be used. Multiple bulb and multiple reflector embodiments are also possible. Accordingly, other embodiments are within the scope of the following claims.

What is claimed is:

1. A light apparatus combination comprising:

first and second light apparatus, each comprising:

an elongate light bulb extending essentially in a longitudinal first direction;

an elongate reflector having a first surface generally facing the bulb and a second surface generally facing away from the bulb, the first surface directing light from the bulb upward from the apparatus; and a housing supporting the reflector and bulb and comprising:

a back portion for mounting the apparatus to a wall;

a lower portion extending forward from the back portion and extending below the reflector and bulb and having an upwardly open channel; and a front element having a lower edge portion accommodated within the channel and extending upward forward of the bulb and at least one of blocking light from the bulb and passing light from the bulb; and a bracket spanning a junction between the lower portions of the first and second apparatus and is secured to said lower portions.

2. The combination of claim 1 wherein the front element of the first light apparatus is a first translucent diffuser and the front element of the second light apparatus is a second translucent diffuser.

3. The combination of claim 1 wherein the front element of the first light apparatus is a first opaque metal panel and the front element of the second light apparatus is a second opaque metal panel.

4. The combination of claim 1 wherein the channel of the first light apparatus extends a majority of a length of the housing of the first light apparatus and the channel of the second light apparatus extends a majority of a length of the housing of the second light apparatus.

5. The combination of claim 1 wherein the bracket has a forward portion contacting aft surfaces of the front elements of the first and second apparatus so as to bias said front elements into alignment with each other.

6. The combination of claim 1 wherein the bracket has a forward portion having a pair of opposed first and second channels respectively capturing associated first and second side edge portions of the front elements of the first and second apparatus so as to retain said front elements in alignment with each other.

7. The combination of claim 1 wherein the bracket is a unitary casting.

8. The combination of claim 1 further comprising:

a first endwall secured to a first end of the housing of the first light apparatus, and no endwall secured to a second end of the first light apparatus opposite said first end.

9. The combination of claim 8 further comprising:

a second endwall secured to a second end of the housing of the second light apparatus, and no endwall secured to an opposite first end of the second light apparatus.

10. An end-to-end assembly of light apparatus comprising:

a plurality of said apparatus assembled end-to end, each comprising:

an elongate light bulb extending essentially in a longitudinal first direction;

an elongate reflector having a first surface generally facing the bulb and a second surface generally facing away from the bulb; and a housing supporting the reflector and bulb and comprising:

a back portion for mounting the apparatus to a wall;

a lower portion extending forward from the back portion and extending below the reflector and bulb and having an upwardly open channel;

a front element having a lower edge portion accommodated within the channel and extending upward forward of the bulb and at least one of blocking light from the bulb and passing light from the bulb; and a top opening passing light from the bulb; and a plurality of brackets, each spanning junctions between adjacent pairs of said apparatus.

11. The assembly of claim 10 further comprising:

a first endwall secured to a first end of the housing of a first of the apparatus; and a second endwall secured to a second end of the housing of a second of the apparatus.

12. A combination comprising:

first and second light apparatus, each comprising:

an elongate light bulb extending essentially in a longitudinal first direction;

an elongate reflector having a first surface generally facing the bulb and a second surface generally facing away from the bulb; and a housing supporting the reflector and bulb and comprising:

a back portion for mounting the apparatus to a wall;

a lower portion extending forward from the back portion and extending below the reflector and bulb and having an upwardly open channel; and a front element having a lower edge portion accommodated within the channel and extending upward forward of the bulb; and a bracket spanning a junction between the lower portions of the first and second apparatus and is secured to said lower portions, the bracket having a forward portion contacting aft surfaces of said front elements so as to bias the front elements into alignment with each other.

13. A combination comprising:

first and second light apparatus, each comprising:

an elongate light bulb extending essentially in a longitudinal first direction;

an elongate reflector having a first surface generally facing the bulb and a second surface generally facing away from the bulb; and a housing supporting the reflector and bulb and comprising:

a back portion for mounting the apparatus to a wall;

a lower portion extending forward from the back portion and extending below the reflector and bulb and having an upwardly open channel; and a front element having a lower edge portion accommodated within the channel and extending upward forward of the bulb; and a bracket spanning a junction between the lower portions of the first and second apparatus and is secured to said lower portions, the bracket having a forward portion having a pair of opposed first and second channels respectively capturing associated first and second side edge portions of the front elements of the first and second apparatus so as to retain said front elements in alignment with each other.

14. An end-to-end assembly of light apparatus comprising:

a plurality of said apparatus assembled end-to end, each comprising:

an elongate light bulb extending essentially in a longitudinal first direction;

an elongate reflector having a first surface generally facing the bulb and a second surface generally facing away from the bulb; and a housing supporting the reflector and bulb and comprising:

a back portion for mounting the apparatus to a wall;

a lower portion extending forward from the back portion and extending below the reflector and bulb and having an upwardly open channel;

an at least partially transparent or translucent diffuser having a lower edge portion accommodated within the channel and extending upward forward of the bulb; and a top opening; and a plurality of brackets, each spanning junctions between adjacent pairs of said apparatus.

* * * * *